US005725427A

United States Patent [19]

Koerber

[11] Patent Number: 5,725,427

[45] Date of Patent: Mar. 10, 1998

[54] FABRIC AIR DIFFUSER, METHOD FOR DIFFUSING AIR, AND METHOD FOR ATTENUATING NOISE ASSOCIATED WITH FLOWING AIR

[75] Inventor: Keith G. Koerber, Goffstown, N.H.

[73] Assignee: Chemfab Corporation, Merrimack, N.H.

[21] Appl. No.: 590,102

[22] Filed: Jan. 24, 1996

[51] Int. Cl.[6] ..... F24F 13/06

[52] U.S. Cl. ..... 454/296; 454/DIG. 906

[58] Field of Search ..... 454/284, 296, 454/297, 298, DIG. 906; 181/224

[56] References Cited

U.S. PATENT DOCUMENTS

| | | | |
|---|---|---|---|
| 3,264,972 | 8/1966 | Averill et al. . | |
| 3,835,758 | 9/1974 | Bean . | |
| 3,948,155 | 4/1976 | Hedrick . | |
| 4,152,474 | 5/1979 | Cook et al. | 428/137 |
| 4,266,470 | 5/1981 | Schroeder et al. . | |
| 4,366,748 | 1/1983 | Wilson et al. . | |
| 4,371,386 | 2/1983 | DeVecchi | 454/296 X |
| 4,603,618 | 8/1986 | Charles . | |
| 4,709,443 | 12/1987 | Bigley | 55/DIG. 3 X |
| 4,861,353 | 8/1989 | Wyss | 55/302 X |
| 4,898,087 | 2/1990 | Fitzner et al. | 454/296 |
| 5,054,379 | 10/1991 | Sodec . | |
| 5,192,348 | 3/1993 | Ludwig | 55/385.2 |
| 5,454,756 | 10/1995 | Ludwig | 454/296 |

FOREIGN PATENT DOCUMENTS

| | | | |
|---|---|---|---|
| 696314 | 10/1964 | Canada | 454/296 |
| 0511736 | 11/1992 | European Pat. Off. . | |
| 4421167 | 12/1995 | Germany . | |
| 6-94295 | 4/1994 | Japan | 454/903 |
| 93/09388 | 5/1993 | WIPO . | |

*Primary Examiner*—Harold Joyce
*Attorney, Agent, or Firm*—White & Case

[57] ABSTRACT

A fabric air diffuser and a method for diffusing air comprises a frame adapted to be connected to the end of an air supply duct. Mounted within the frame is a flat, open-weave, fabric sheet. The fabric sheet redirects and scatters air passing through the openings in the weave by changing the direction and velocity of the air upon exiting the sheet.

11 Claims, 3 Drawing Sheets

FABRIC AIR DIFFUSER, METHOD FOR DIFFUSING AIR, AND METHOD FOR ATTENUATING NOISE ASSOCIATED WITH FLOWING AIR

BACKGROUND OF THE INVENTION

1. Field of the Invention

The present invention relates generally to air diffusers for environmental control systems in commercial and residential buildings. The invention relates specifically to a fabric air diffuser that can be used in place of conventional diffusers. The invention also relates to a method for diffusing air and a method for attenuating the noise associated with flowing air.

2. Description of the Prior Art

Air diffusers redirect air as it flows into a room from a ceiling mounted supply duct. Without a diffuser, the air provided by the duct will flow straight down into the room. This can cause undesirable air drafts within the room.

The prior art diffusers solve this and other problems by redirecting and diffusing the air as it enters the room. To accomplish this goal, the exit "face" of a typical prior art diffuser has a group of angled vanes or louvers.

Prior art diffusers that utilize angled vanes include those set forth in U.S. Pat. No. 3,948,155, issued Apr. 6, 1976 (Warren R. Hedrick), U.S. Pat. No. 4,266,470, issued May 12, 1981 (Schroeder et al.), U.S. Pat. No. 4,366,748, issued Jan. 4, 1983 (Wilson et al.), U.S. Pat. No. 5,054,379, issued Oct. 8, 1991 (Franc Sodec), U.S. Pat. No. 5,192,348, issued Mar. 9, 1993 (Craig S. Ludwig), and U.S. Pat. No. 5,454,756, issued Oct. 3, 1995 (Craig S. Ludwig).

Fabric sheets have been used in diffuser systems to filter dust and other particulate matter from the air passing into the room. U.S. Pat. No. 4,603,618, issued Aug. 5, 1986 (Charles W. Soltis), discloses a clean room ventilation system having a fabric sheet fixed above a perforated ceiling grid. The fabric sheet filters the air and provides a uniform laminar flow of air into the room. The fabric sheet and perforated grid extend across the entire ceiling, and air flows from the ceiling straight down into the room.

The prior art air diffusers have many problems. They often accumulate dust, which tends to build up around the angled vanes. In addition, the prior art air-handling systems tend to be noisy.

Fabrics have also been used to absorb sound. U.S. Pat. No. 4,152,474, issued May 1, 1979 (Cook, deceased et al.), discloses an acoustic absorber which comprises a substrate having a plurality of openings. An organic polymer coating covers the substrate and partially fills the openings in the substrate.

It would be desirable to provide a light-weight air diffuser, which does not have the problems associated with the air diffuser of the prior art. It would also be desirable to provide and method for diffusing and a method for attenuating the noise associated with the diffusion of air.

SUMMARY OF THE INVENTION

The present invention relates to a fabric air diffuser and a method for diffusing air. The diffuser comprises a frame that is adapted to be connected to the end of an air supply duct. Mounted within the frame is an open-weave, fabric sheet. The fabric sheet changes the direction and velocity of air upon exiting the sheet. More particularly, the fabric sheet redirects and scatters air flowing perpendicularly into the sheet. Upon exiting the weave openings, the air flows laterally to the sheet and radially outward in all directions. The degree of lateral deflection depends on flow rate, weave opening size, and fabric thickness.

An additional aspect of the invention is that the fabric sheet is coated with a soil-resistant material. The soil-resistant material inhibits adherent dust and other particulate matter from accumulating on the fabric and, therefore, eases cleaning the diffuser.

The fabric and coating are preferably constructed of non-combustible material, such as fiberglass fabric and a polytetrafluoroethylene (PTFE) coating.

A further aspect of the invention is that the fabric air diffuser can be used for attenuating the noise associated with air flowing through a defined volume, such as an air duct. By disposing the open-weave, fabric sheet across an entire cross-sectional area of the volume, the sheet attenuates the noise that would otherwise be generated as the air passes through the volume. Specifically, the fabric air diffuser may be used in place of a conventional, angled-vane diffuser which typically generates a substantial noise as air passes by the vanes.

The fabric air diffuser may be employed in a variety of air distribution systems, such as, heating/cooling/ventilation (HVAC) systems.

DETAILED DESCRIPTION OF THE PREFERRED EMBODIMENT

Figure 1:
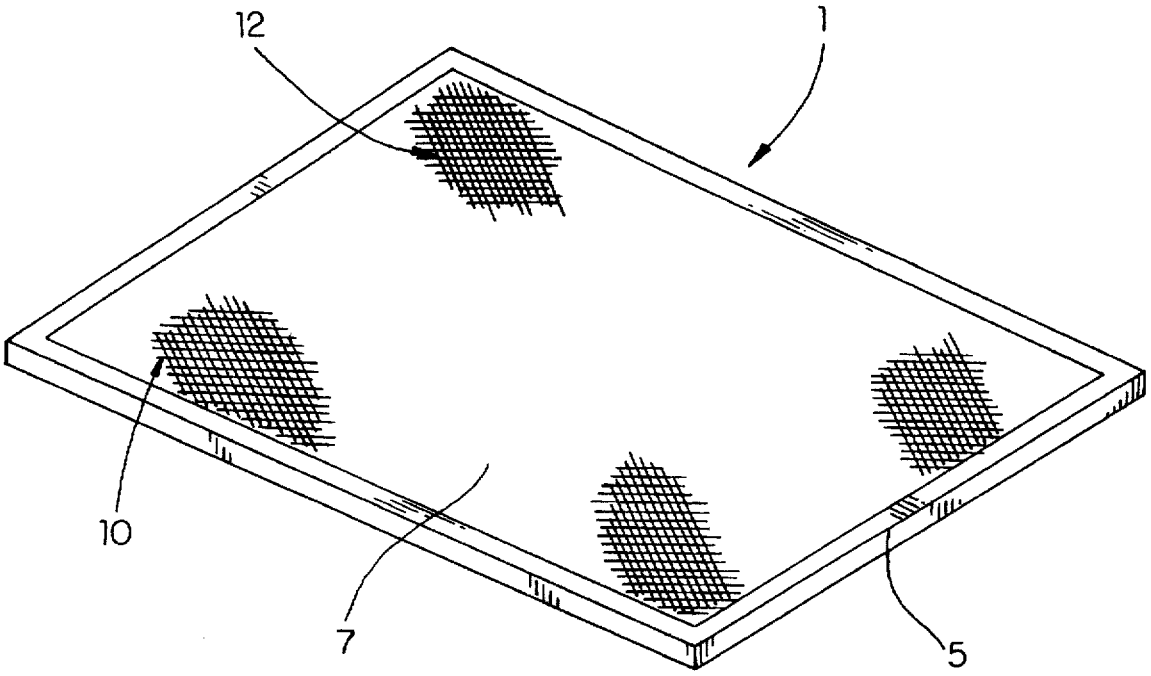
FIG. 1 is a perspective view of the fabric air diffuser of the present invention.

Referring to FIG. 1., in the preferred embodiment, the fabric diffuser 1 of the invention comprises a rectangular frame 5 adapted to be connected to the end of a typical air supply duct. Mounted within the rectangular frame is a flat, open-weave, glass, fabric sheet 7. The yarns of the fabric sheet are preferably coated with a soil-resistant material (not shown in the figures). The coating does not completely fill in the open-weave area of the sheet. Thus a substantial open area is maintained in the sheet. The soil-resistant material is preferably a fluoropolymer, such as polytetrafluoroethylene (PTFE), although other low surface energy polymers, such as fluoropolymers, may be employed.

The fabric sheet 7 is constructed of interwoven warp and fill yarns 10 and 12, respectively, that are typically perpendicular to each other. In the preferred embodiment, the warp and fill yarns 10 and 12, respectively, extend diagonally across the rectangular frame 5. However, the yarns may also be aligned parallel to the edges of the frame. The diagonal orientation of the yarns can simplify mounting the fabric within the frame, but the orientation may vary to create the desired aesthetic effect.

Figure 2:
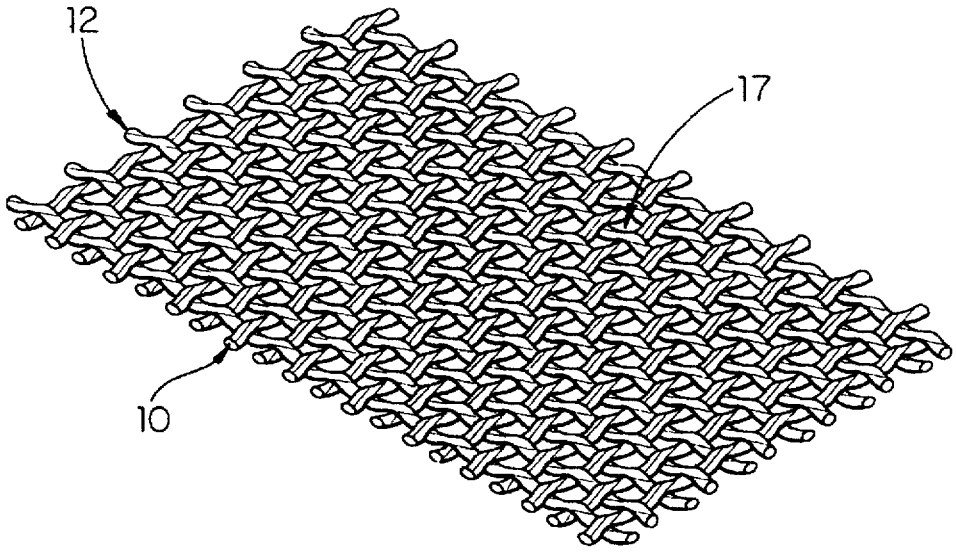
FIG. 2 is a perspective view of the open-weave fabric used in the present invention.
Figure 3:
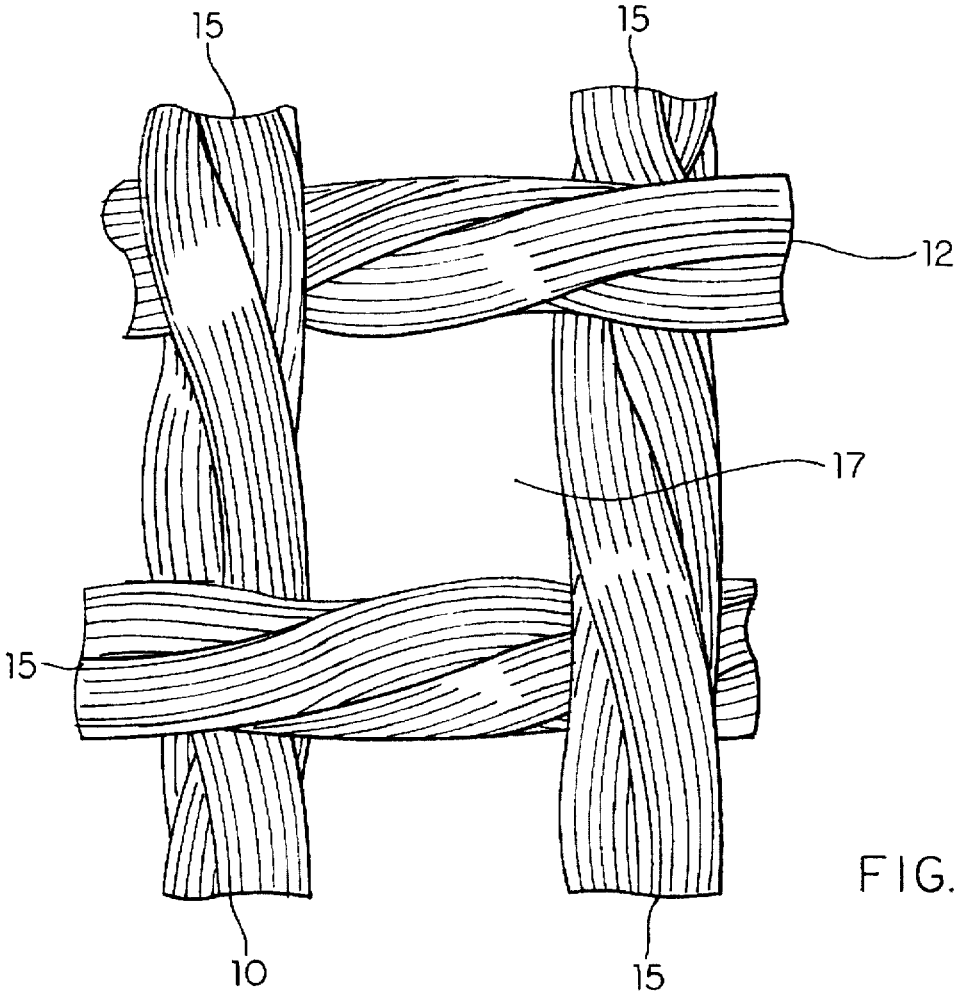
FIG. 3 is a magnified top-view of the open-weave fabric illustrating a preferred weave and also illustrating the construction of the warp and fill yarns.

Referring to FIGS. 2 and 3, the warp yarns 10 and fill yarns 12 are interwoven in a cross-over pattern. Each yarn is composed of a multiplicity of fine filaments 15 that are plied together into the twisted bundles. The circular cross-sectional diameter of the warp and fill yarns prior to weaving is approximately 28 mils (1 mil=$1\times10^{-3}$ inch). After weaving, the cross-sectional shape of the yarn is elliptical.

The fabric sheet has an open weave 17. Each opening is essentially square-shaped, and is approximately 50×50 mils. The total open area comprises approximately 38% of the area of the fabric. The thickness of the fabric sheet is approximately 23 mils. The dimensions given for the fabric are operable for air volumes and presssures associated with conventional air-handling systems. The dimensions of the fabric sheet may vary, however, depending on the volume and pressure of the air flowing into the fabric and the amount of deflection desired.

Figure 4:
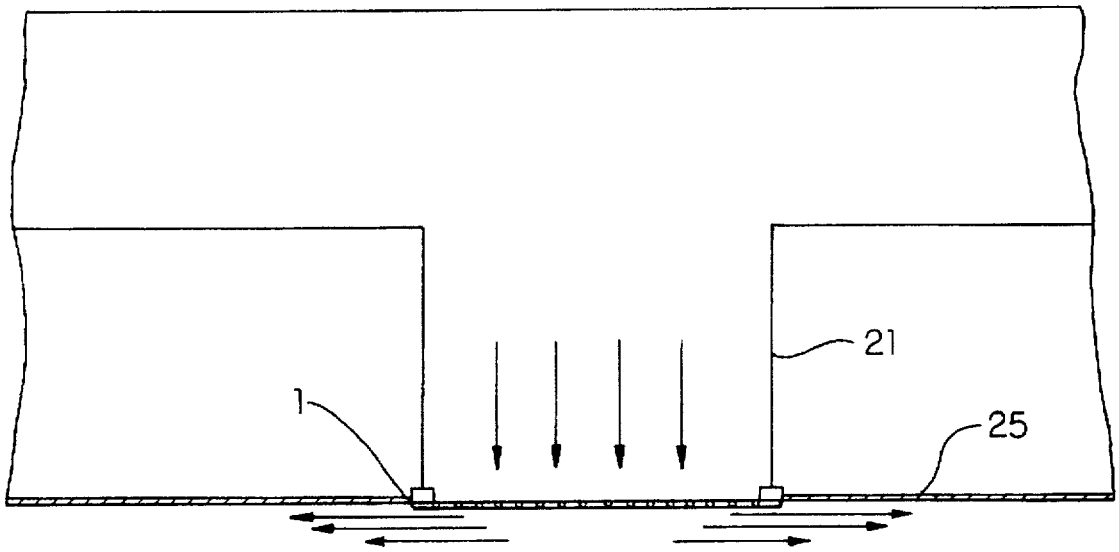
FIG. 4, which is a side view of the diffuser mounted on the end of an air supply duct, shows the change in direction of the air upon exiting the fabric sheet.
Figure 5:
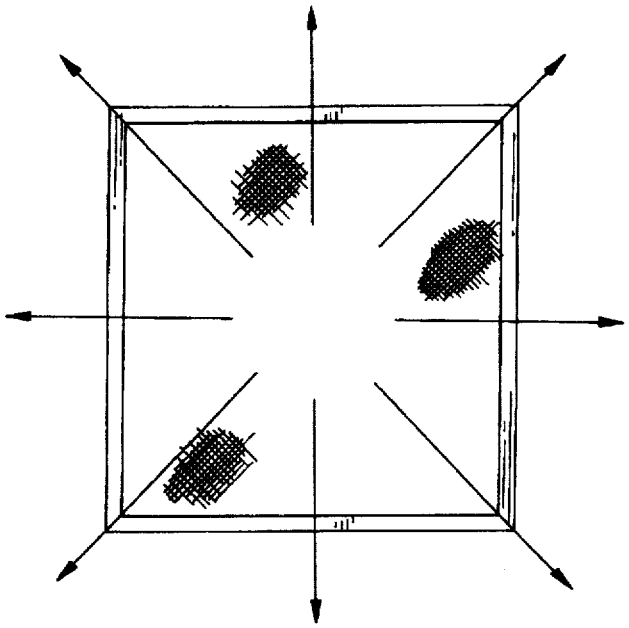
FIG. 5, which is a bottom view of the diffuser mounted on an air supply duct, shows the air exiting the sheet radially in all directions.

Referring now to FIG. 4, the fabric air diffuser 1 is connected to the end of an air supply duct 21, which is usually flush with the surface of the ceiling 25 in a room. The diffuser 1 is oriented on the end of the air supply duct 21 so that air from the duct flows perpendicularly into the fabric sheet. In FIGS. 4 and 5, the direction of air flow is denoted by arrows. The fabric sheet changes the direction and velocity of the air upon exiting the sheet. The redirected air flows laterally to the sheet, as shown by the arrows in FIG. 4, and flows radially outward in all directions, as shown by the arrows in FIG. 5 (a bottom view). This redirection causes the air to hug the ceiling or wall depending on the placement of the particular diffuser and supply duct. While in the preferred embodiment the air exiting the openings flows laterally to the sheet and radially outward, it is envisioned that fabrics of varying types and dimensions can be employed to deflect air in other patterns. Also, while in the preferred embodiment the fabric sheet is a flat configuration, it is envisioned that the sheet may be employed in a curved formation, for example, by thermo-forming it into a dish-shaped configuration.

EXAMPLE 1

A sheet of Chemglas®1589, PTFE-coated glass fabric, manufactured by Chemfab Corporation, Merrimack, N.H., approximately 23 inches square was mounted within a rectangular frame adapted for connection to the end of an air supply duct. The sheet had the same dimensions as given in the above description and was mounted such that the warp and fill yarns extended diagonally across the rectangular frame.

The diffuser was then mounted to the end of an air supply duct which was flush with the ceiling surface. The redirection and speed of the flow of air was then observed. The air stream flowing perpendicularly into the fabric abruptly changed directions to flow laterally or relatively parallel to the plane of the fabric.

Furthermore, as one traversed the plane of the fabric with an anemometer, a "dead zone," i.e., an area where the air velocity is virtually zero, was found on the surface of the fabric in the center area of the fabric plane. The deflected air flowed radially outward from the dead zone in all directions. Virtually no air flow was observed when the measuring device was located several inches below the ceiling. The horizontal component of air flow that is, the throw, extended significantly beyond the fabric-covered opening away from the air flow source in all directions yet maintaining its "ceiling hugging" characteristics.

It was further observed that the noise of the air passing through the fabric was much less noticeable than the noise associated with conventional diffusers.

What is claimed is:

1. A fabric air diffuser for an air supply duct, the diffuser comprising:

a frame for connecting the diffuser to the air supply duct; and an open-weave, fabric sheet mounted in the frame, the sheet for changing the direction of the air upon exiting the sheet;

wherein the sheet is flat, is composed of an essentially non-combustible material, and is coated with a soil-resistant non-combustible composition.

2. The fabric air diffuser of claim 1, wherein the soil-resistant composition is a low surface energy polymer.

3. The fabric air diffuser of claim 2, wherein the soil-resistant composition comprises PTFE.

4. The fabric air diffuser of claim 3, wherein the frame is rectangular in shape and the fabric has warp and fill yarns extending diagonally across the frame.

5. A method for diffusing air flowing from an air supply duct, the method comprising:

providing an open-weave, fabric sheet for changing the direction of air upon exiting the sheet;

mounting the fabric in a frame; and connecting the frame to the air supply duct;

wherein the sheet is flat, is composed of an essentially non-combustible material, and is coated with a soil-resistant, non-combustible composition.

6. The method of claim 5, wherein the soil resistant composition is a low surface energy polymer.

7. The method of claim 6, wherein the soil resistant composition comprises PTFE.

8. The method of claim 7, wherein the frame is rectangular in shape and the fabric is mounted in the frame with the warp and fill yarns extending diagonally across the frame.

9. A method for attenuating the noise associated with air flowing through a defined volume, the method comprising:

disposing an open-weave, fabric sheet across an entire cross-sectional area of the volume, the sheet for changing the direction of the air upon exiting the sheet to attenuate the noise generated as the air passes through the sheet;

wherein the fabric sheet is flat, is composed of an essentially non-combustible material, and is coated with a soil-resistant, non-combustible composition.

10. The method according to claim 9 wherein the soil-resistant composition is a low surface energy polymer.

11. The method according to claim 10 wherein the soil-resistant composition comprises PTFE.

* * * * *